US005436620A

United States Patent [19]

Ide

[11] Patent Number: 5,436,620

[45] Date of Patent: Jul. 25, 1995

[54] PAGING RECEIVER CAPABLE OF RAPIDLY JUDGING NECESSITY OF KEEPING AN INCOMING MESSAGE

[75] Inventor: Motoki Ide, Tokyo, Japan

[73] Assignee: NEC Corporation, Tokyo, Japan

[21] Appl. No.: 966,353

[22] Filed: Oct. 26, 1992

[30] Foreign Application Priority Data

Oct. 24, 1991 [JP] Japan ..... 3-305365

[51] Int. Cl.[6] ..... G08B 5/22

[52] U.S. Cl. ..... 340/825.44; 340/825.22

[58] Field of Search ..... 340/825.44, 825.22, 340/825.27, 311.1; 455/38.2, 38.4; 371/69

[56] References Cited

U.S. PATENT DOCUMENTS

| | | | |
|---|---|---|---|
| 4,477,807 | 10/1984 | Nakajima et al. | 340/825.44 |
| 4,835,777 | 5/1989 | DeLuca et al. | 371/69 |
| 5,043,718 | 8/1991 | Shimura | 340/825.44 |
| 5,075,684 | 12/1991 | DeLuca | 340/825.44 |
| 5,093,659 | 3/1992 | Yamada | 340/825.44 |
| 5,140,561 | 8/1992 | Miyashita et al. | 340/825.44 X |

*Primary Examiner*—Donald J. Yusko

*Assistant Examiner*—Edwin C. Holloway, III

*Attorney, Agent, or Firm*—Sughrue, Mion, Zinn, Macpeak & Seas

[57] ABSTRACT

In a paging receiver having a processing unit (15) which produces an incoming message in response to reception of a radio signal specifically directed to the receiver, the processing unit compares the incoming message with each of selected messages selected from particular messages which are memorized in a message memory (18). Only when the incoming message is not coincident with at least one of the selected messages, the processing unit produces an activating signal. In accordance with the activating signal, the processing unit stores the incoming messages as one of the particular messages in the message memory. When the incoming message is coincident with at least one of the selected messages, the incoming message is not stored in the message memory. Preferably, when one of the selected messages is memorized in the message memory continuously in excess of a predetermined time period while the incoming message is coincident with the one of the selected messages, the processing unit renews the one of the selected messages.

5 Claims, 3 Drawing Sheets

PAGING RECEIVER CAPABLE OF RAPIDLY JUDGING NECESSITY OF KEEPING AN INCOMING MESSAGE

BACKGROUND OF THE INVENTION

This invention relates to a paging receiver which is operable in a paging system and has a duplicate memory inhibiting function known in the art.

A conventional paging receiver includes a number memory and a receiving circuit. The number memory is for memorizing a plurality of identification numbers specific to the paging receiver. The receiving circuit is for receiving a radio signal specifically directed to the receiver. The radio signal carries a call number and message information. When the call number indicates a particular one of the identification numbers, the receiving circuit receives the radio signal to produce an incoming message including the message information and others.

The conventional paging receiver further comprises a message memory, a judging circuit, and a storing circuit. The message memory is for memorizing a plurality of particular messages. The judging circuit is for carrying out judgement operation of judging whether or not it is necessary to keep the incoming message. When it is necessary to keep the incoming message, the judging circuit produces an activating signal. In accordance with the activating signal, the storing circuit stores the incoming message as one of the particular messages in the message memory. It is to be noted that the storing circuit does not store the incoming message in the message memory when the judging circuit does not produce the activating signal. This means that the conventional paging receiver has the duplicate memory inhibiting function.

The conventional paging receiver has a disadvantage in that a long time is required for carrying out the judgement operation as will later be discussed in detail.

SUMMARY OF THE INVENTION

It is therefore an object of this invention to provide a paging receiver which is capable of saving a time for judging whether or not it is necessary to keep an incoming message.

Other objects of this invention will become clear as the description proceeds.

According to this invention, there is provided a paging receiver including a message memory for memorizing a plurality of particular messages, receiving means for producing an incoming message by receiving a radio signal specifically directed to the receive, and judging means for judging whether or not it is necessary to keep the incoming message. The judging means produces an activating signal when it is necessary to keep the incoming message. The paging receiver further comprises storing means for storing the incoming message as one of the particular messages in the message memory in accordance with the activating signal. In the paging receiver, the judging means comprises integer determining means for determining a predetermined integer and selecting means connected to the message memory and the number determining means for selecting selected messages, a specific integer in number, from the particular messages. The specific integer is not greater than the predetermined integer. The judging means further comprises comparing means connected to the storing and the selecting means for comparing the incoming message with each of the selected messages to produce a particular signal as the activating signal only when the incoming message is not coincident with at least one of the selected messages.

DESCRIPTION OF THE PREFERRED EMBODIMENT

Figure 1:
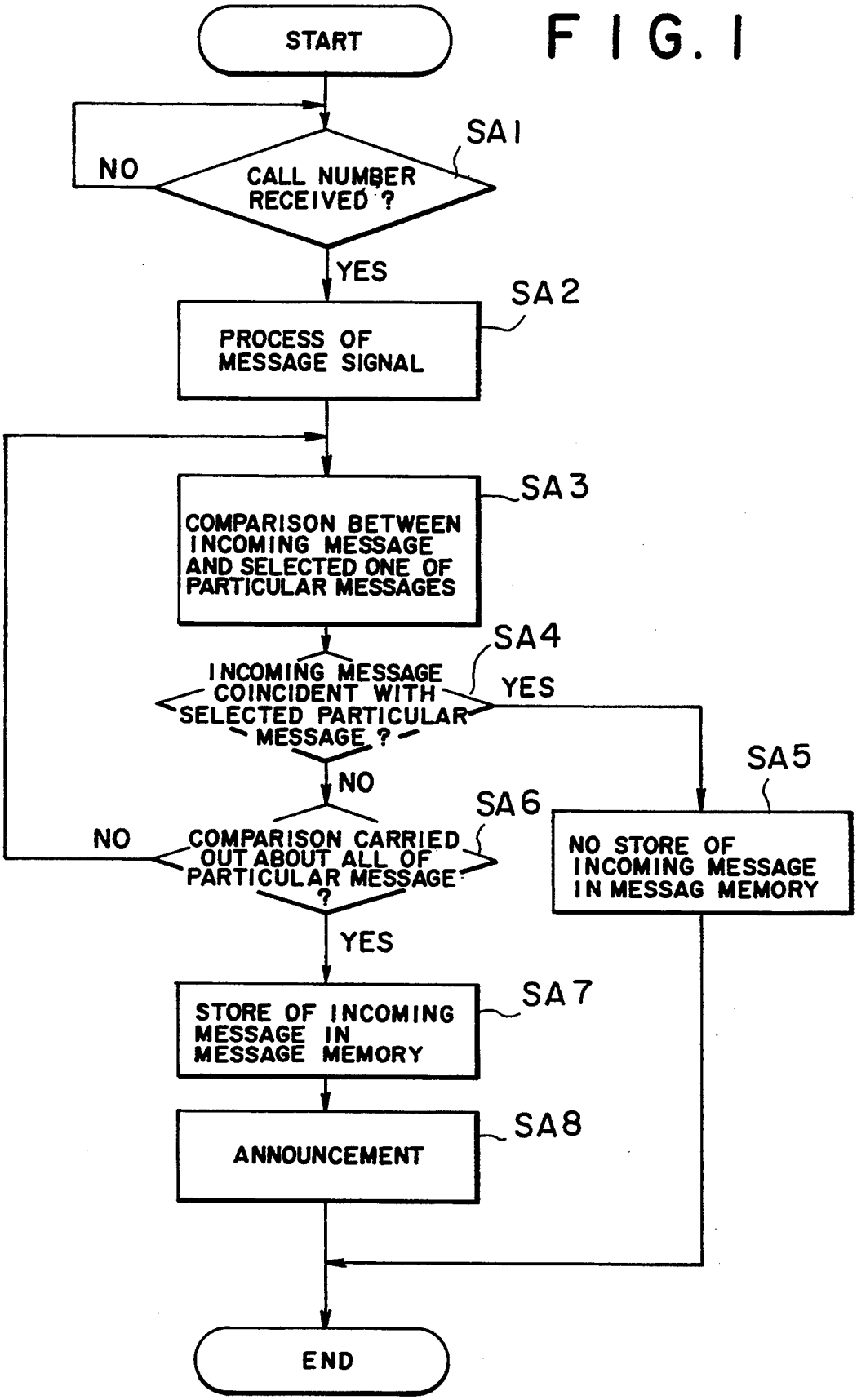
FIG. 1 is a flow chart for use in describing operation of a conventional radio paging receiver.

Referring to FIG. 1, operation of a conventional paging receiver will first be described for a better understanding of the present invention. The conventional paging receiver is for selectively receiving a plurality of call signals which are directed to the receiver. Each of the call signals comprises a call number signal and a message signal following the call number signal and is transmitted as a radio signal from a transmitting station (not shown). The message signal represents message information. The call number signal represents a call number assigned to the paging receiver at which the message should be received. In the manner known in the art, the conventional paging receiver comprises a message memory for memorizing a plurality of particular messages.

In FIG. 1, a start stage proceeds to a first stage SA1 at which judgement is carried out whether or not the paging receiver receives the call number that is assigned to the paging receiver. When the paging receiver receives the call number, the first stage SA1 is followed by a second stage SA2 at which the paging receiver carries out predetermined reception operation. More particularly, the paging receiver decodes the message signal into the message information to store, as an incoming message, a combination of the message information and additional information in a message buffer known in the art.

The second stage SA2 proceeds to a third stage SA3 at which comparison operation is carried out between the incoming message and a selected one of the particular messages. The third stage SA3 proceeds to a fourth stage SA4 at which judgement is carried out whether or not the incoming message is coincident with the selected particular message. When the incoming message is coincident with the selected particular message, the fourth stage SA4 is followed by a fifth stage SA5 at which the incoming message is deleted from the message buffer without being memorized in the message memory. The fifth stage SA5 proceeds to an end stage at which the operation finishes.

When the incoming message is not coincident with the selected particular message, the fourth stage SA4 is followed by a sixth stage SA6 at which judgement is carried out whether or not the comparison operation is carried out with respect to all of the particular messages. When the comparison operation is not carried out with respect to all of the particular messages, the sixth stage SA6 returns to the third stage SA3 at which the comparison operation is carried out between the incoming message and another of the particular messages. The third through the sixth stages SA3 to SA6 are repeated.

When the comparison operation is carried out with respect to all of the particular messages, the sixth stage SA6 is followed by a seventh stage SA7 at which the incoming message is read from the message buffer and is stored as one of the particular messages in the message memory. The seventh stage SA7 proceeds to an eighth stage SA8 at which a light emitting diode and a loudspeaker are driven to announce reception of the incoming message to possessor of the receiver. The eighth stage SA8 proceeds to the end stage at which the operation finishes.

In as much as the comparison operation is successively carried out with respect to all of the particular messages, the conventional paging receiver has a disadvantage that a long time is required for judging whether or not it is necessary to memorize the incoming message in the message memory. The disadvantage is increased in any one of cases where the particular messages are great in number and where the incoming message has a great number of words. In order to remove the disadvantage, the paging receiver must comprise a microprocessor which is excellent in its function. However, such a microprocessor makes the paging receiver expensive.

In the manner known in the art, the conventional paging receiver has a memory backup function of keeping the particular messages in the message memory after electric power is disenergized from the receiver. It will be assumed in this connection that the incoming message is coincident with an old one of the particular messages. In this event, the conventional paging receiver has another disadvantage in that the incoming message can not be stored in the message memory if the old particular message is memorized in the message memory several days before.

Figure 2:
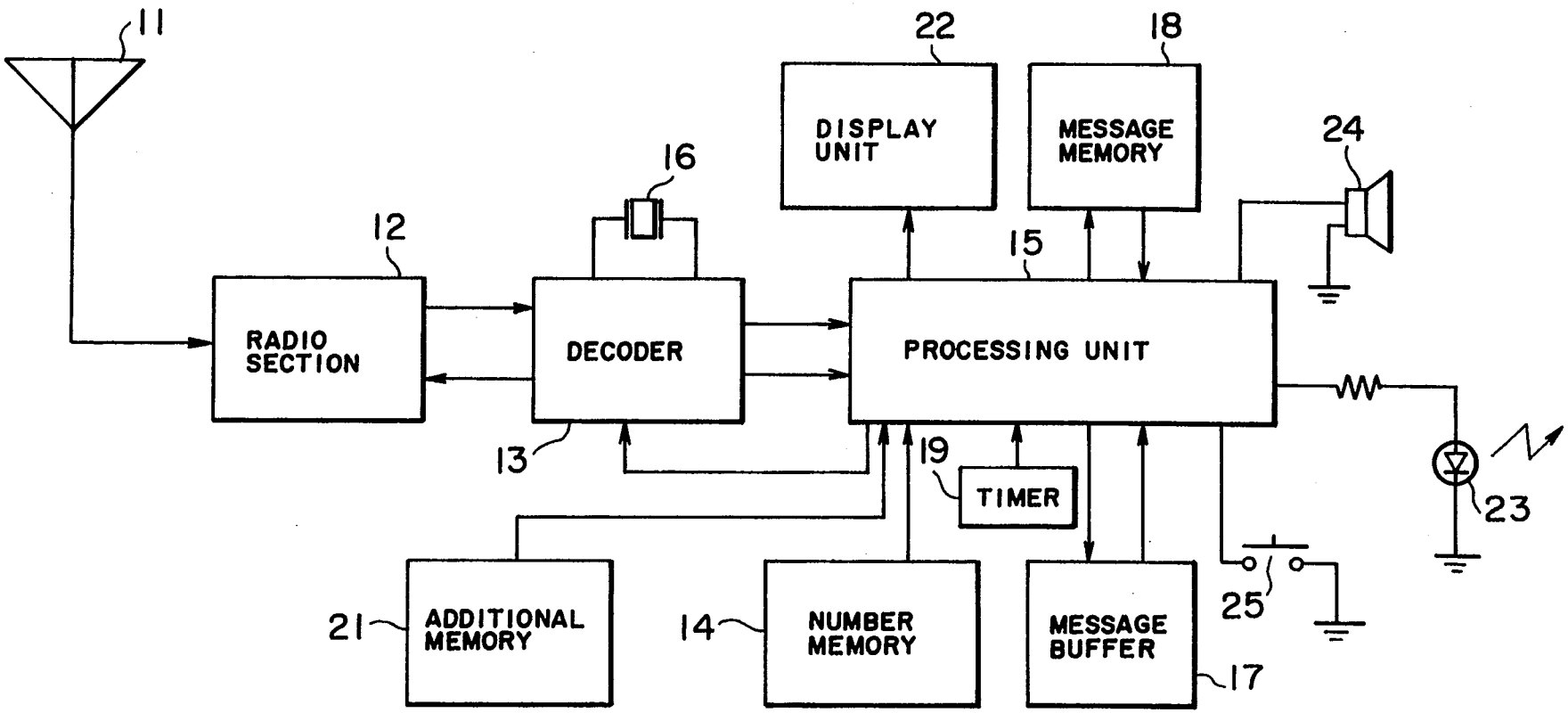
FIG. 2 is a block diagram of a paging receiver according to an embodiment of this invention.

Turning to FIG. 2, the description will be directed to a paging receiver according to a preferred embodiment of this invention. The paging receiver comprises an antenna 11 for receiving the radio signal. The radio signal is picked up by the antenna 11 and supplied to a radio section 12. The radio section 12 converts or demodulates the radio signal into a baseband or demodulated signal. The demodulated signal is supplied to a decoder 13. In the known manner, the radio section 12 is intermittently operable in response to a battery saving signal which is supplied from the decoder 13.

The paging receiver further comprises a number memory 14 and a processing unit 15 of a one-chip microcomputer. The number memory 14 is connected to the processing unit 15 and comprises a read only memory for memorizing a plurality of identification numbers specific to the paging receiver. The processing unit 15 reads the identification numbers from the number memory 14 when energized by electric power in the manner known in the art. The identification numbers are sent from the processing unit 15 to the decoder 13.

Using the demodulated signal, the decoder 13 carries out judgement operation of judging whether or not the call number is coincident with a particular one of the identification numbers. Only when the call number is coincident with the particular number, the decoder 13 produces a coincidence detection signal. Subsequently, the decoder 13 decodes the demodulated signal to produce a decoded signal. The coincidence detection and the decoded signals will later become clear. A combination of the coincidence detection and the decoded signals is supplied as a received signal to the processing unit 15. The decoder 13 operates in response to a pulse signal from an oscillator 16 in the manner known in the art.

The coincidence detection signal represents call discrimination information which indicates the particular number. The decoded signal represents the message information. The processing unit 15 stores, as an incoming message, a combination of the call discrimination information and the message information in a message buffer 17 that is a random access memory.

In the manner described above, the paging receiver carries out the before-mentioned predetermined reception operation. In this event, a combination of the antenna 11, the radio section 12, the decoder 13, the number memory 14, and the processing unit 15 is referred to as a receiving arrangement.

In the manner which will be described in the following, the paging receiver further comprises a message memory 18, a timer 19, and an additional memory 21, each of which is connected to the processing unit 15. The message memory 18 comprises a random access memory for memorizing, a preselected integer M in number, the particular messages. The preselected integer M is equal to, for example, ten. It will be assumed that each of the particular messages comprises the call discrimination information and the message information.

The timer 19 is for producing a time signal indicating a current time. The time signal is supplied to the processing unit 15.

The additional memory 21 is for memorizing a predetermined integer N and a predetermined time period T. The predetermined integer N is equal to, for example, three. The predetermined time period T is equal to, for example 24 hours. The additional memory 21 is referred to as an integer determining arrangement and will alternatively be referred to as a time determining arrangement.

The processing unit 15 selects selected messages of a specific integer in number from the particular messages. The specific integer is not greater than the predetermined integer N. In this event, the processing unit 15 is referred to as a selected arrangement.

In the manner which will later be described in detail, the processing unit 15 carries out judgement operation of judging whether or not it is necessary to keep the incoming message. When it is necessary to keep the incoming message, the processing unit 15 produces an activating signal. In this event, the processing unit 15 is referred to a judging arrangement.

In accordance with the activating signal, the processing unit 15 stores the incoming message as one of the particular messages in the message memory 18 together with the additional information that represents the current time. In this event, the processing unit 15 is referred to as a storing arrangement. When it is unnecessary to keep the incoming message, the processing unit 15 deletes the incoming message from the message buffer 17 without storing the incoming message in the message memory 18.

The incoming message is displayed on a display unit 22 of a liquid crystal display. In addition, a light emitting diode 23 and a loudspeaker 24 are driven to announce reception of the incoming message to a possessor of the receiver. It is possible to repeatedly display the incoming message on the display unit 22 in response to operation of a displaying switch 25.

Figure 3:
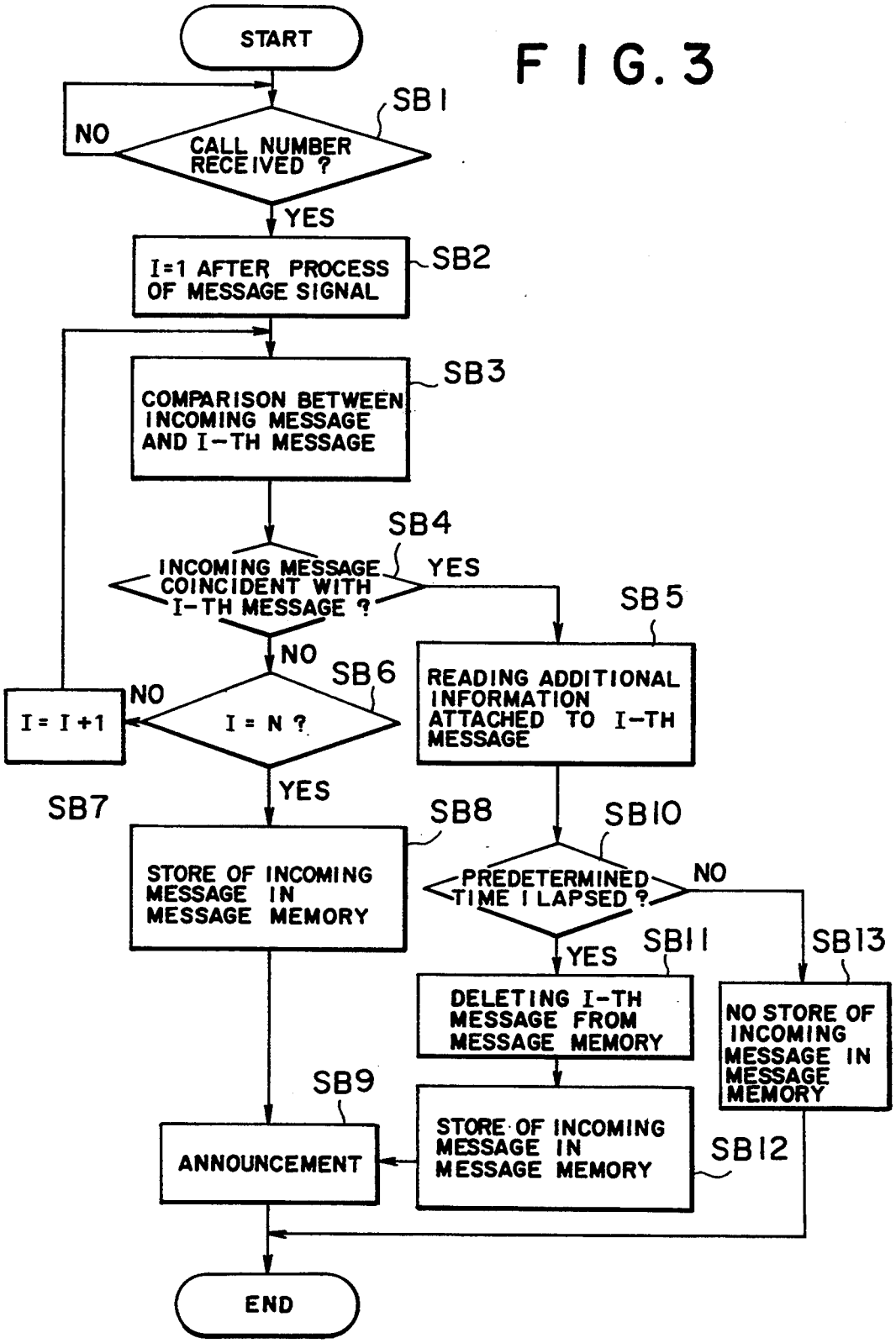
FIG. 3 is a flow chart for use in describing operation of the radio paging receiver illustrated in FIG. 2.

Referring to FIG. 3 together with FIG. 2, operation of the paging receiver will be described as regards a case where the message memory 18 memorizes the particular messages of the preselected integer M at a plurality of time instants. In response to the particular messages in the message memory 18, the processing unit 15 gives message numbers to the particular messages in time order in accordance with the time instants. The particular messages will be called hereafter first, second through (N−1)-th and N-th through M-th messages which are numbered in time order from a fresheet one of the particular messages to an oldest one of them. In this event, the processing unit 15 will be referred to as a number giving arrangement.

A start stage proceeds to a first stage SB1 at which judgement is carried out in the decoder 13 whether or not the paging receiver receives the call number. In other words, the decoder 13 carries out judgement whether or not the call number is coincident with the particular identification number. Only when the call number is coincident with the particular number, the first stage SB1 is followed by a second stage SB2 at which the decoder 13 gives one to a particular value I after carrying out the above-mentioned predetermined reception operation.

The second stage SB2 proceeds to a third stage SB3 at which the processing unit 15 carries out comparison operation between the incoming message and a I-th message, namely, the first message. The third stage SB3 proceeds to a fourth stage SB4 at which the processing unit 15 judges with reference to a result of the comparison operation whether or not the incoming message is coincident with the first message. When the incoming message is coincident with the first message, the processing unit 15 produces a specific signal. When the processing unit 15 produces the specific signal, the fourth stage SB4 is followed by a fifth stage SB5 which will later be described.

When the incoming message is not coincident with the first message, the fourth stage SB4 is followed by a sixth stage SB6 at which the processing unit 15 judges whether or not the particular value I is equal to the predetermined integer N. When the particular value I is not equal to the predetermined number N, the sixth stage SB6 is followed by a seventh stage SB7 at which the processing unit 15 adds one to the particular value I. The seventh stage SB7 returns to the third stage SB3 at which the processing unit 15 carries out the comparison operation between the incoming the I-th message which is now the second message. The third through the seventh stages SB3 to SB7 are repeated. For carrying out the sixth and the seventh stages SB6 and SB7, the processing unit 15 will be referred to as a local selecting arrangement.

In the manner described above, the processing unit 15 carries out the judgement operation of judging whether or not the incoming message is coincident with each of the first through the N-th messages. When the particular value I is equal to the predetermined integer N, the sixth stage SB6 is followed by an eighth stage SB6 at which the processing unit 15 read the incoming message from the message buffer 17 and stores the incoming message in the message memory 18 together with the additional information that represents the current time.

The eighth stage SB8 proceeds to a ninth stage SB9 at which the processing unit 15 carries out predetermined announcing operation. More particularly, the processing unit 15 makes the display unit 22 display the incoming message on the display unit 22. In addition, the processing unit 15 drives the light emitting diode 23 and the loudspeaker 24 to announce reception of the incoming message to the possessor. The ninth stage SB9 proceeds to an end stage at which the operation finishes.

The description will be directed to the fifth stage SB5 at which the processing unit 15 accesses the message memory to read the additional information that is attached to the I-th message. The fifth stage SB5 proceeds to a tenth stage SB10 at which the processing unit 15 judges with reference to the additional information and the time signal whether or not the I-th message is memorized in the message memory 18 continuously in excess of the predetermined time period T. When the I-th message is memorized in the message memory 18 continuously in excess of the predetermined time period T, the processing unit 15 produces a time lapse signal which indicates that the I-th message is an old particular message. On carrying out the fifth and the tenth stages SB5 and SB10, the processing unit 15 will be referred to as a time period judging arrangement.

When the processing unit 15 produces the time lapse signal, the tenth stage SB10 is followed by an eleventh stage SB11 at which the processing unit 15 deletes the I-th message from the message memory 18. In this event, the processing unit 15 will be referred to as a message deleting arrangement.

The eleventh stage SB11 proceeds to a twelfth stage SB12 at which the processing unit 15 reads the incoming message from the buffer memory 17 to store the incoming message in the message memory 18 together with the additional information that represents the current time. In this event, the processing unit 15 will be referred to as an additional storing arrangement. On carrying out the eleventh and the twelfth stages SB11 and SB12, the processing unit 15 will be referred to as a memory renewing arrangement.

The twelfth stage SB12 proceeds to the ninth stage SB9 at which the processing unit 15 carries out the predetermined announcing operation.

When the processing unit 15 does not produce the time lapse signal, the tenth stage SB10 is followed by a thirteenth stage SB13 at which the incoming message is abandoned in the buffer memory 17. The thirteenth stage SB13 proceeds to the end stage. In this event, the processing unit 15 does not store the incoming message in the message memory 18. Therefore, the processing unit 15 will be referred to herein as an inhibiting arrangement.

While the present invention has thus far been described in connection with only a single embodiment thereof, it will readily be possible for those skilled in the art to put this invention into practice in various other manners. For example, it is preferable that each of the predetermined time period and the predetermined number can be changed by the possessor.

What is claimed is:

1. A paging receiver including a message memory for memorizing a plurality of particular messages, receiving means for receiving a radio signal specifically directed to said receiver, said receiving means producing an incoming message, judging means for judging whether or not it is necessary to keep said incoming message, said judging means producing an activating signal when it is necessary to keep said incoming message, and storing means for storing said incoming message as one of said particular messages in said message memory in accordance with said activating signal, said judging means comprising:

integer determining means for determining a predetermined integer;

selecting means connected to said message memory and said integer determining means for selecting selected messages, a specific integer in number, from said particular messages, said specific integer being not greater than said predetermined integer; and comparing means connected to said storing and said selecting means for comparing said incoming message with all of said selected messages to produce a particular signal as said activating signal only when said incoming message is not coincident with any of said selected messages, said comparing means producing a specific signal when said incoming message is coincident with one of said selected messages, said paging receiver further comprising:

time determining means for determining a predetermined time period;

time period judging means connected to said message memory and said time determining means for judging whether or not said one of the selected messages is memorized in said message memory continuously in excess of said predetermined time period, said time period judging means producing a time lapse signal when said one of the selected messages is continuously memorized in said message memory in excess of said predetermined time period; and memory renewing means connected to said comparing and said time period judging means for renewing said one of the selected messages in accordance with said specific signal and said time lapse signal.

2. A paging receiver as claimed in claim 1, said particular messages being memorized in said message memory at a plurality of time instants, wherein said selecting means comprises:

number giving means connected to said message memory for giving message numbers to said particular messages in time order in accordance with said time instants; and local selecting means connected to said number giving means for selecting, as said selected messages, fresh ones of said particular messages with reference to said message numbers.

3. A paging receiver as claimed in claim 1, wherein said comparing means produces a specific signal when said incoming message is coincident with one of said selected messages, said paging receiver further comprising preventing means connected to said storing and said comparing means for preventing said incoming message in response to said specific signal from being memorized in said message memory.

4. A paging receiver as claimed in claim 1, wherein said renewing means comprises:

message deleting means connected to said comparing and said time period judging means for deleting said one of the selected messages from said message memory in accordance with said specific and said time lapse signals; and additional storing means connected to said comparing and said time period judging means for storing said incoming message into said message memory in accordance with said specific and said time lapse signals.

5. A paging receiver as claim in claim 1, further comprising inhibiting means connected to said time period judging and said renewing means for inhibiting operation of said renewing means in response to said specific signal while said time period judging means does not produce said time lapse signal.

* * * * *

UNITED STATES PATENT AND TRADEMARK OFFICE

CERTIFICATE OF CORRECTION

PATENT NO. : 5,436,620
DATED : July 25, 1995
INVENTOR(S) : Motoki Ide

It is certified that error appears in the above-indentified patent and that said Letters Patent is hereby corrected as shown below:

Col. 5, line 9, delete "fresheet" and insert --freshest--.

Signed and Sealed this

Twenty-first Day of November, 1995

Bruce Lehman

*Attest:*

BRUCE LEHMAN

*Attesting Officer*

*Commissioner of Patents and Trademarks*